US005467869A

United States Patent [19]

Elie et al.

[11] Patent Number: 5,467,869

[45] Date of Patent: Nov. 21, 1995

[54] EYEGLASS LENS PACKAGING

[75] Inventors: François Elie, Paris; Vincent Rossin, Montrouge, both of France

[73] Assignee: Essilor International Cie Generale d'Optique, Charenton le Pont, France

[21] Appl. No.: 345,455

[22] Filed: Nov. 21, 1994

[30] Foreign Application Priority Data

Nov. 23, 1993 [FR] France ..... 93 13988

[51] Int. Cl.[6] ..... B65D 85/38

[52] U.S. Cl. ..... 206/45.13; 206/6; 206/316.1

[58] Field of Search ..... 206/45.13, 45.15, 206/45.18, 5, 6, 303, 316.1, 445

[56] References Cited

U.S. PATENT DOCUMENTS

| | | | |
|---|---|---|---|
| 1,547,142 | 7/1925 | Bausch | 206/316.1 |
| 2,262,472 | 11/1941 | Sloan | 206/44 |
| 2,672,977 | 3/1954 | Seitz | 206/83 |
| 2,880,858 | 4/1959 | Persky | 206/45.13 |
| 3,233,953 | 2/1966 | Seabury | 312/244 |
| 3,289,823 | 12/1966 | Weiser | 206/8 |
| 3,635,335 | 1/1972 | Kramer | 206/82 |
| 4,010,845 | 3/1977 | Bloomfield | 206/82 |
| 5,176,250 | 1/1993 | Cheng | 206/45.13 |

FOREIGN PATENT DOCUMENTS

| | | | |
|---|---|---|---|
| 0021900 | 1/1981 | European Pat. Off. . | |
| 572743 | 2/1924 | France . | |
| 191178 | 7/1990 | Japan | 206/316.1 |

*Primary Examiner*—Jimmy G. Foster
*Attorney, Agent, or Firm*—Young & Thompson

[57] ABSTRACT

A display container for eyeglass lenses includes a plate to receive the eyeglass lens to be displayed and two half-shells pivoted to the edge of the plate about a pivot axis globally perpendicular to the plate. Each half-shell can move between a closed position wherein, juxtaposed to each other, they conjointly form a protective shell around the plate, and an open position in which they uncover the plate. The plate has a globally circular contour, has no rim over at least part of its edge and has locally projecting from it at least three locking pegs for holding the eyeglass lens.

17 Claims, 3 Drawing Sheets

EYEGLASS LENS PACKAGING

BACKGROUND OF THE INVENTION

1. Field of the Invention

The present invention is generally concerned with the display packaging in which an eyeglass lens is usually supplied to a practitioner.

2. Description of the Prior Art

At present this packaging is usually a case similar to a jewel case.

The case has a box body which encloses a packing member including a recess in which the eyeglass lens is placed and a lid hinged to the body.

A case of this kind is satisfactory and may continue to be so.

It does have the following drawbacks, however.

Firstly, the eyeglass lens is to some degree embedded in its housing with the result that it is difficult to extract it so that it can be held in the hand.

In practise it is extremely difficult if not impossible to extract it in the correct way, holding it only by its edge.

One or more fingers usually come unintentionally into contact with one or other of the main surfaces of the lens with the virtually inevitable risk of soiling them.

Also, for the eyeglass lens to be visible in the packaging the lid is usually made from a transparent and therefore relatively costly material, so increasing the overall cost of the packaging.

Cases, boxes, containers and packaging suitable for displaying diverse products are known from the following patents, for example: U.S. Pat. No. 2,262,472, U.S. Pat. No. 3,635,335, EP-A-0 021 900, U.S. Pat. No. 3,233,953, FR-A-572 743 and U.S. Pat. No. 3,289,823.

Document U.S. Pat. No. 2,262,472 describes a display container intended for use as a necklace presentation case, for example, and including a plate adapted to receive the necklace and in practise having a semicircular contour and two half-shells pivoting at the edge of the plate about a pivot axis generally perpendicular to the plate, each moving between a closed position in which they are juxtaposed and together form a protective shell around the plate and an open position in which they uncover the plate.

The wig case described in document U.S. Pat. No. 3,289,823 is very similar.

None of these patent documents is formally directed to the display of an eyeglass lens and none of the cases, boxes, containers or packaging which are the subject matter of these documents is specifically adapted for such display.

In document U.S. Pat. No. 2,262,472, for example, the plate on which the necklace is laid and/or fixed has a rim all around its periphery so that removing the necklace from the plate entails a gesture in a direction substantially perpendicular to the plate.

Applied to an eyeglass lens, the corresponding arrangement would almost inevitably cause handling problems and in practise soiling of one or both of the main surfaces of the lens, as previously.

A general object of the present invention is a display container which is free of these drawbacks and has further advantages.

SUMMARY OF THE INVENTION

The present invention consists in a display container for eyeglass lenses including a plate adapted to receive an eyeglass lens to be displayed and two half-shells pivoted to the edge of the plate about a pivot axis globally perpendicular thereto and each mobile between a closed position wherein, juxtaposed to each other, they conjointly form a protective shell around the plate, and an open position in which they uncover the plate, wherein said plate has a globally circular contour, has no rim over at least part of its edge and has locally projecting from it at least three locking pegs for holding the eyeglass lens.

The eyeglass lens rests freely on the plate, at least part of its peripheral edge is freely exposed, and it is therefore easy to grasp it by this edge, in practise by a gesture in a direction substantially parallel to the plate, with no risk of soiling of either of its main surfaces.

The display container of the invention requires only a small number of component parts none of which is particularly costly to manufacture.

Finally, of compact overall size, it advantageously lends itself to storage in a bin with others.

The general conditions of display to a practitioner are therefore facilitated.

The features and advantages of the invention will emerge from the following description given by way of example with reference to the appended diagrammatic drawings.

DETAILED DESCRIPTION OF THE PREFERRED EMBODIMENTS

Figure 2:
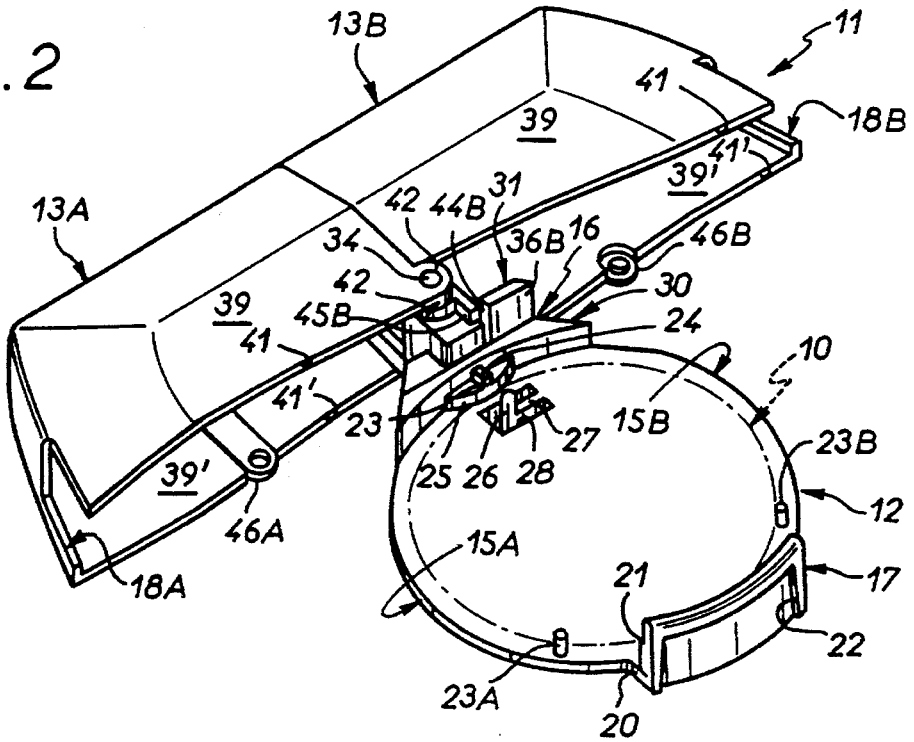
FIG. 2 is a perspective view of it shown open.

The overall object is to display an eyeglass lens 10 shown diagrammatically in chain-dotted line in FIG. 2.

In this context, by "eyeglass lens" 10 is meant the circular blank which constitutes the eyeglass lens 10 before it is trimmed to match the contour of the rim or surround of the eyeglass frame to which it is to be fitted.

Figure 1:
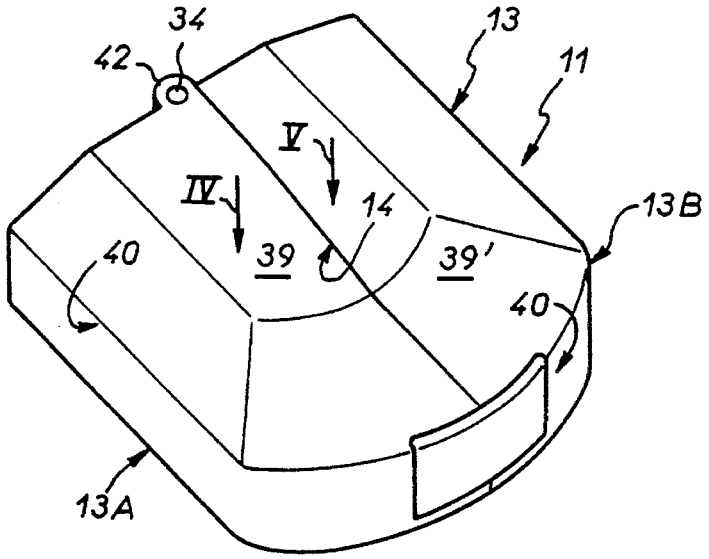
FIG. 1 is a perspective view of a display container in accordance with the invention shown closed.

The packaging used in accordance with the invention for displaying an eyeglass lens 10 of this kind is a container 11 including a plate 12 adapted to receive the eyeglass lens 10 to be displayed and which in practise, reflecting the shape of the latter, has a substantially circular contour, and two half-shells 13A, 13B mounted to pivot at the edge of the plate 12 about a pivot axis generally perpendicular to the plate and each mobile between a closed position (FIG. 1) in which they are juxtaposed along a mating surface 14 and conjointly form a protective shell 13 around the plate 12 and an open position (FIG. 2) in which they expose the lens to a greater or lesser degree, in practise completely.

In accordance with the invention, the plate 12 has no rim over at least part of its edge.

In the embodiments shown the plate 12 has no rim along two diametrally opposed portions 15A, 15B of its edge each of which subtends an angle of slightly less than 180°.

In other words, the plate 12 is essentially a flat disk.

In the embodiments shown, the plate 12 has, locally projecting from its edge between the portions 15A, 15B thereof, a back 16 on the reverse side of which the two half-shells 13A, 13B pivot, by virtue of arrangements described in more detail below.

Diametrally opposite the back 16 is a rim 17 locally projecting from the edge of the plate 12 between the portions 15A, 15B of the latter; it projects to the same side of the plate 12 as the back 16 and when closed respective notches 18A, 18B on the two half-shells 13A, 13B each engage with it.

In the embodiments shown the rim 17 is in practise at the end of a portion 20 of the plate 12 extending forward in the radial direction.

It forms along its free edge a slot 21 which nests with the two half-shells 13A, 13B and has on its main outside surface a recess 22 to receive a label.

In accordance with the invention, the plate 12 also has at least three locking pegs 23, 23A, 23B locally projecting from it, near its edge, one centrally and the other two at the sides, their function being to hold the eyeglass lens 10 to be displayed.

The locking pegs 23, 23A, 23B are disposed along a common circumference.

In the embodiments shown the middle locking peg 23 is formed by the end of a rib 24 projecting radially from the back 16 towards the axis of the plate 12 and upstanding from a convex seat 25 at the base of the rib 24 where the plate 12 and the back 16 merge.

The freestanding side locking pegs 23A, 23B are on respective sides of the diameter running from the back 16 to the rim 17, one in each portion 15A, 15B of the edge of the plate 12.

In the embodiment of the invention shown in FIGS. 1 to 10 they are cylindrical pegs with a circular transverse section and are slightly inset from the edge of the plate 12.

These cylindrical pegs preferably have some elasticity.

Finally, in the embodiments shown, the plate 12 has an additional locking peg 26 projecting locally from its surface away from the edge.

This locking peg 26 is in practise on the diameter running from the back 16 to the rim 17, at a small distance from the middle locking peg 23.

It is at the end of a tang 27 which is in one piece and coplanar with the plate 12, being formed inside an opening 28 in the latter. This tang is elastically deformable in the radial direction relative to the plate 12 and has its free end generally rounded (hemispherical).

In the embodiments shown the two half-shells 13A, 13B are pivoted to the same point on the plate 12, on the reverse side of the back 16.

The back 16 is in practise in two parts, one part 30 molded in one piece with the plate 12, like the rim 17, and forming the middle locking peg 23, the rib 24 and the seat 25, and a separate part 31 attached to it, for example by nesting, welding or glueing, and on which the two pivoting half-shells 13A, 13B are mounted.

In the embodiments shown, the part 31 (shown in isolation in FIGS. 3, 9 and 10) has in the middle a hub 32 with an axial bore 33 to receive a pin 34 on which the two half-shells 13A, 13B pivot.

The part 31 also includes two spaced parallel fins 35 with slots 36 between them, one on each side of the hub 32.

Two lugs 37 project from the back of the part 30, separated by the width of the hub 32 of the part 31. The lugs 37 insert in the slots 36 of the part 31 to attach it thereto.

In practise one of the fins 35 is at the bottom of the hub 32 and the other half way up its height.

For reasons that emerge below the first carries a rib 38A projecting downwards along its free edge on the side of the hub 32 corresponding to the half-shell 13A. The second similarly carries a rib 38B projecting upwards along its free edge on the side of the hub 32 corresponding to the half-shell 13B.

In practise the rib 38B is higher than the rib 38A.

It is in fact higher than the hub 32.

Each of the two half-shells 13A, 13B includes, firstly, globally parallel upper and lower main walls 39, 39' which are globally parallel to the plate 12, one above and one below the latter, and, secondly, a side wall 40 globally perpendicular to the plate 12 and joining the two main walls 39, 39' to form a pocket, terminating at a distance from the free edge 41, 41' of the latter to form the respective notch 18A, 18B.

At the end of their free edge 41, 41' opposite the notch 18A, 18B the main walls 39, 39' of the half-shells 13A, 13B are each locally extended by lugs 42, 42' which fit over and pivot on the pin 34.

The lugs 42, 42' project from the side wall 40 and the free edges 41, 41' of the main walls 39, 39' are joined to their contour, on a first side of this contour for one of the free edges 41, 41' and on the opposite side for the other.

As a result, seen in plan, the free edges 41, 41' do not overlap.

To the contrary, originating from the same point (corresponding to the end of the notches 18A, 18B), they diverge from this common point as far as the lugs 42, 42'.

The arrangements are reversed between one half-shell 13A, 13B and the other, so that the dispositions are complementary, the combination forming the mating surface 14 in the closed position.

Abutment means are preferably operative between the back 16 and the half-shells 13A, 13B in the open position, as shown.

In the embodiments shown the abutment means include, for each of the two half-shells 13A, 13B, a shoulder 44A, 44B on the back 16 and a tab 45A, 45B projecting from the half-shell 13A, 13B and bearing against the shoulder 44A, 44B in the open position.

In practise the shoulders 44A, 44B on the back 16 are formed by the mutually facing lateral edges of the ribs 38A, 38B of the part 31 a portion of which forms the back 16.

Conjointly, the tab 45A, 45B on the half-shell 13A, 13B is near the lug 42 for the half-shell 13B and near the lug 42' for the half-shell 13A, projecting from the contour of the lugs 42, 42' substantially perpendicularly to the free edge 41, 41' of the corresponding main wall 39, 39'.

In practise the arrangements are such that, in the open position as shown in FIG. 2, the two half-shells 13A, 13B are globally aligned with each other, tangentially to the plate 12.

For there then to be some continuity between the half-shells 13A, 13B their side wall 40 preferably extends globally perpendicularly to the free edges 41, 41' of their main walls 39, 39' over at least part of the contour of the latter starting from their pivot axis, i.e. the pin 34.

The side wall 40 thereafter extends globally parallel to the free edges 41, 41' of the main walls 39, 39' before curving in a circular sector shape towards the end of the latter opposite the lugs 42, 42'.

Thus in plan view (FIGS. 4 and 5) the two half-shells 13A, 13B each have a globally rectangular contour with the corner diagonally opposite the lugs 42, 42' rounded off in a circular shape.

In the embodiments shown, the main wall 39, i.e. that above the plate 12 in the closed position, is slightly domed so that in the closed position the two half-shells 13A, 13B form a continuous bulge over the plate 12, whereas the main wall 39' is flat.

The half-shells 13A, 13B are preferably associated with snap fastener means for releasably locking them in the closed position.

In the embodiment shown these snap fastener means are carried by two tangs 46A, 46B on the free edge 41' of and each locally extending the main wall 39' of the half-shells 13A, 13B and overlap in the closed position.

In practise the tangs 46A, 46B have a semi-circular contour and to be able to overlap they are half the thickness of the main wall 39'.

One of the tangs 46A, 46B carries a projecting boss 47, for example, whereas the other has a hole 48 in it, in corresponding relationship to the boss 47 to form a housing in which the latter is engaged.

The plate 12 and the part 31 which forms a portion of the back 16 of the plate 12 can advantageously be made (in practise molded) from a synthetic material.

Likewise the two half-shells 13A, 13B.

After the pin 34 on which the two half-shells 13A, 13B pivot is fitted, it is immobilized in the axial direction relative to the assembly.

The eyeglass lens 10 to be displayed can be wedged either between the side locking pegs 23A, 23B and the middle locking peg 23, in which case the additional locking peg 26 is removed reversibly by cutting through the tang 27 carrying it at its base, or between the side locking pegs 23A, 23B and the additional locking peg 26, rather than the middle locking peg 23.

The display container 11 of the invention therefore has the advantage of being able to display eyeglass lenses 10 having either of two different diameters.

Given the elasticity of the side locking pegs 23A, 23B and the additional locking peg 26 when the latter is used, the usual manufacturing tolerances in respect of the eyeglass lens 10 are advantageously catered for, and the lens is held securely.

For example, the two half-shells 13A, 13B are the same color, and this can be any color.

The plate 12, on the other hand, is preferably of a color matched to the type of eyeglass lens to be displayed, because it forms a background for the latter: for example, a dark color plate 12 shows an anti-reflection coating better, whereas a light color plate 12 shows more clearly the color of an eyeglass lens, especially a photochromic eyeglass lens.

The rim 17, which can be seen even when the presentation container 11 is closed, shows from outside the type of eyeglass lens contained in the display container 11, since it is the same color as the plate 12.

Separated from the half-shells 13A, 13B, and more precisely from the part 31 which joins the latter together, the plate 12 can at least initially be stored separately from the two half-shells 13A, 13B, if desired.

When closed, the display container 11 of the invention has the general shape of a relatively flat and compact plate.

A plurality of display containers 11 can therefore be placed in a common storage bin 49, globally parallel to each other.

Figure 11:
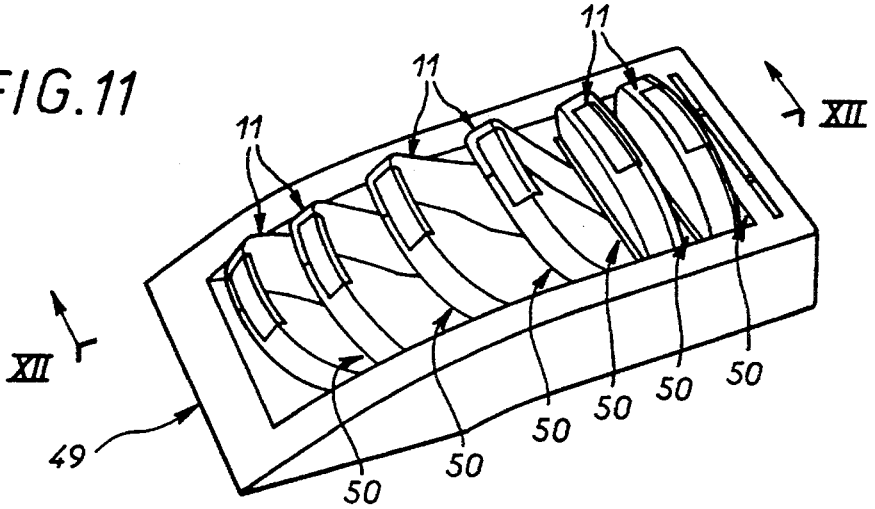
FIG. 11 is a perspective view of a storage bin in which a plurality of display containers in accordance with the invention are stored.
Figure 12:
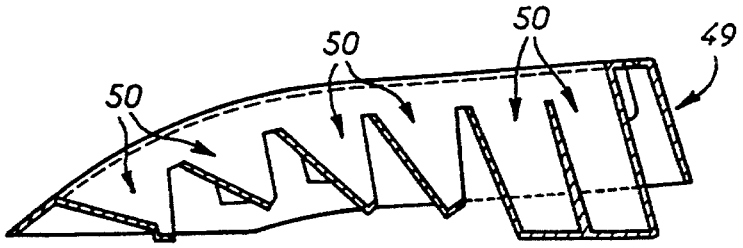
FIG. 12 is a view of this bin in longitudinal section on the line XII—XII in FIG. 11 and to a larger scale.

To this end, and as shown in FIGS. 11 and 12, the storage rack 49 forms a plurality of transverse pockets 50 staggered along its length and each adapted to receive one display container 11.

In the embodiment of the invention shown the pockets 50 progressively diverge in the manner of a fan to facilitate grasping the display containers 11 they contain.

Figure 13:
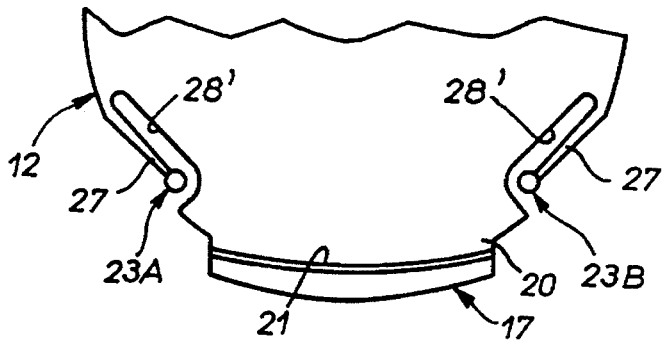
FIG. 13 is a partial plan view of an alternative embodiment of the plate of the display container of the invention.
Figure 3:
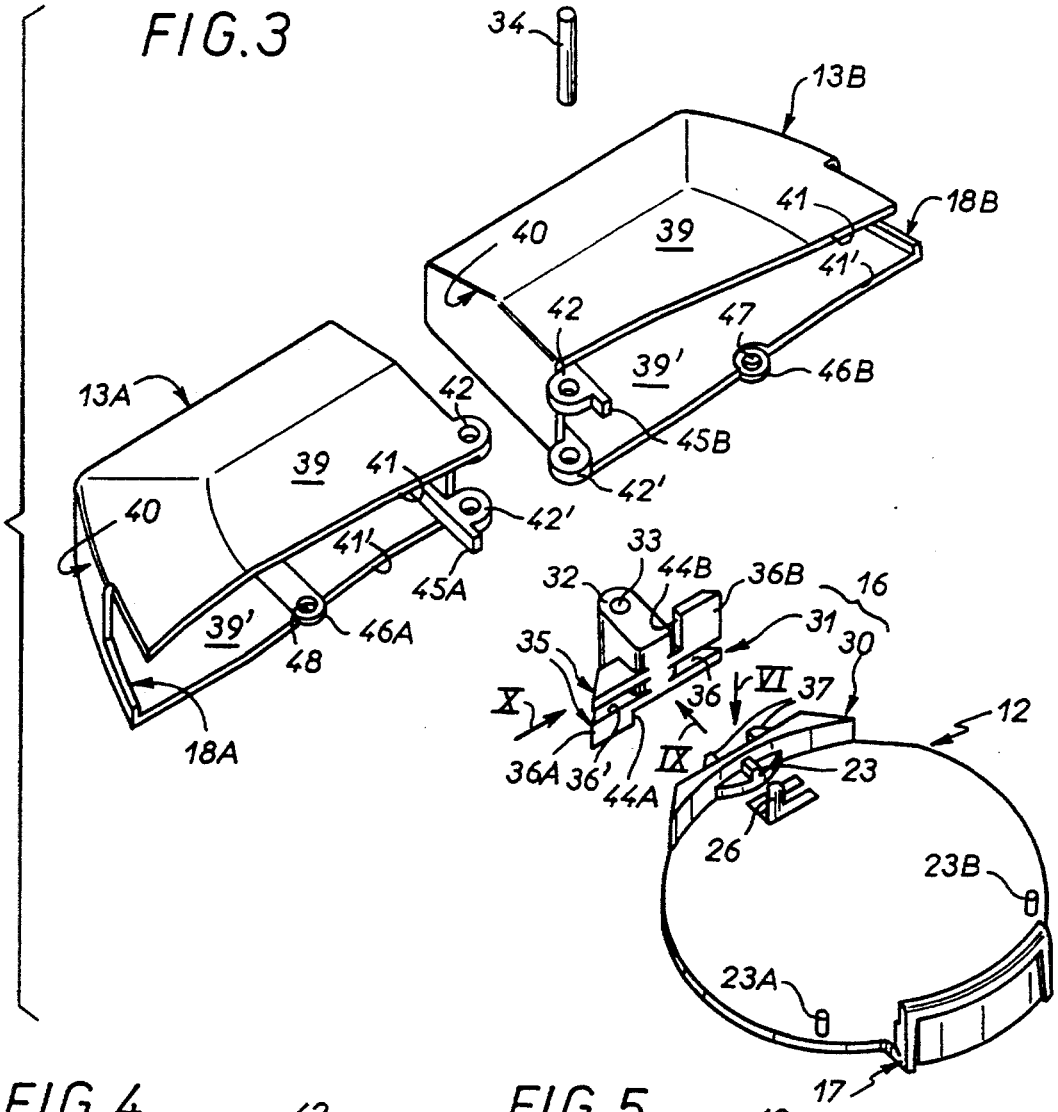
FIG. 3 is an exploded perspective view of it.
Figure 4:
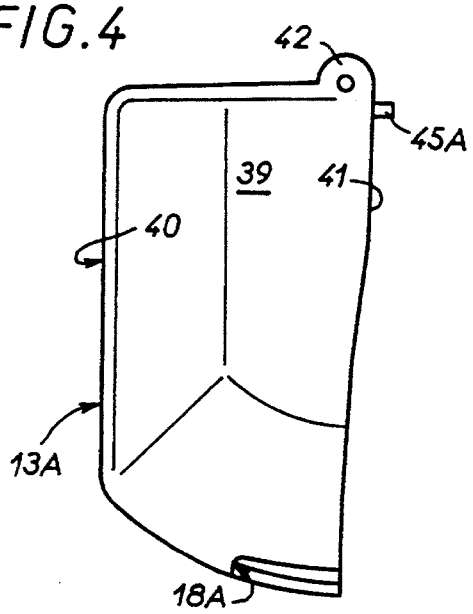
FIG. 4 is a plan view of one of the two half-shells that it comprises, as seen in the direction of the arrow IV in FIG. 1.
Figure 5:
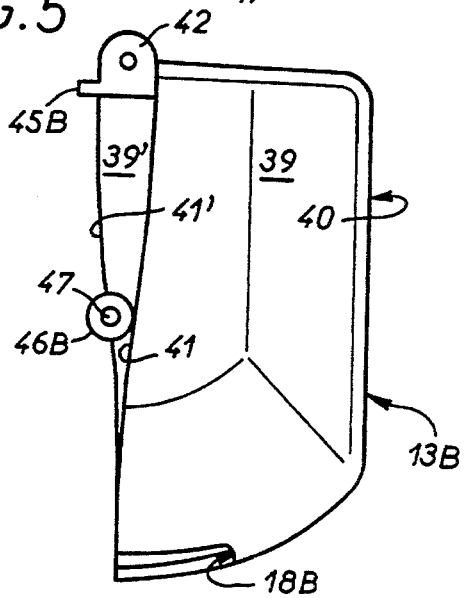
FIG. 5 is a plan view of the other half-shell as seen in the direction of the arrow V in FIG. 1.
Figure 6:
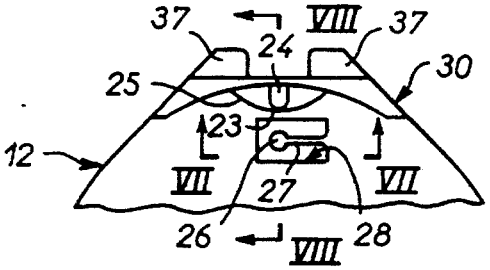
FIG. 6 is a partial plan view of the plate as seen in the direction of the arrow VI in FIG. 3.
Figure 8:
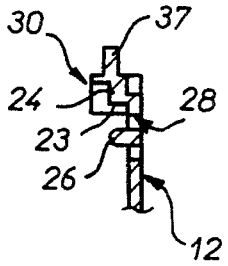
FIGS. 7 and 8 are partial views of the plate in transverse section on the respective lines VII—VII and VIII—VIII in FIG. 6.
Figure 7:
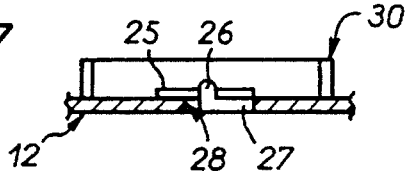
Figure 9:
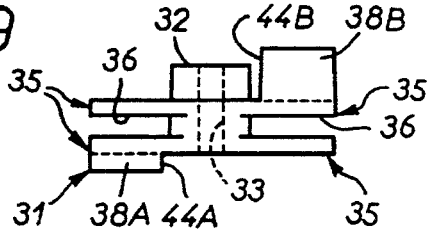
FIG. 9 is a view in elevation to a larger scale and as seen in the direction of the arrow IX in FIG. 3 of one of the component parts of the back which the plate incorporates for mounting the pivoting half-shells.
Figure 10:
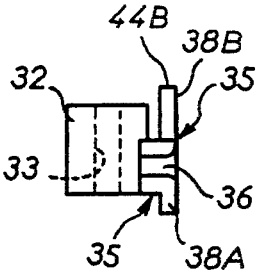
FIG. 10 is a side view of this part as seen in the direction of the arrow X in FIG. 3.

In the embodiment of the invention shown in FIG. 13 at least one of the side locking pegs 23A, 23B on the plate 12 (both of them in practise) is, like the additional locking peg 26, at the end of an elastically deformable tang 27 at the edge of the plate 12 and molded in one piece with it. The tang 27 is substantially tangential to the plate 12, lying inside a notch 28' in the latter.

Like the additional locking peg 26, the side locking pegs 23A, 23B then each exhibit elasticity in the radial direction relative to the plate 12.

Of course, the present invention is not limited to the embodiments described and shown but encompasses any variant execution and/or combination of the various component parts thereof.

In particular, instead of being mounted to pivot at the same point on the plate, the two half-shells could be mounted so that each pivots at one of two diametrally opposite points on the plate.

Also, instead of uncovering the plate completely in the open position, the two half-shells could uncover it only partially, provided that the lens carried by the plate nevertheless remains accessible.

There is claimed:

1. Display container for eyeglass lenses including a plate adapted to receive an eyeglass lens to be displayed and two half-shells pivoted to the edge of said plate about a pivot axis globally perpendicular thereto and each mobile between a closed position wherein, juxtaposed to each other, they conjointly form a protective shell around said plate, and an open position in which they uncover said plate, wherein said plate has a globally circular contour, has no rim over at least part of its edge and has locally projecting from it at least three locking pegs for holding said eyeglass lens.

2. Display container according to claim 1 wherein said plate has no rim along two diametrally opposed portions of its edge.

3. Display container according to claim 1 wherein said plate has an additional locking peg projecting from its surface away from its edge.

4. Display container according to claim 1 wherein at least one of said locking pegs on said plate is at the end of a tang elastically deformable in the radial direction relative to the plate.

5. Display container according to claim 1 wherein said plate is substantially a flat disk.

6. Display container according to claim 1 wherein said two half-shells are pivoted at a common point on said plate.

7. Display container according to claim 6 wherein said plate has locally projecting from its periphery a back on the reverse side of which both of said half-shells are pivoted.

8. Display container according to claim 7 wherein abutment means are operative between said back and said half-shells in their open position.

9. Display container according to claim 8 wherein said abutment means for each of said half-shells include a shoulder on said back and a tang projecting from said half-shell and bearing against said shoulder in said open position.

10. Display container according to claim 7 wherein said back is in two parts, namely a part molded in one piece with said plate and a part on which said two half-shells pivot.

11. Display container according to claim 7 wherein said plate has locally projecting at its edge a rim diametrally opposite said back and with which respective notches in said two half-shells engage in the closed position.

12. Display container according to claim 6 wherein said two half-shells are substantially aligned with each other tangentially to said plate in the open position.

13. Display container according to claim 1 wherein each of said two half-shells has two main walls globally parallel to each other and to said plate and a side wall globally perpendicular to said plate and joining said main walls together to form a pocket.

14. Display container according to claim 13 wherein said lateral wall is globally perpendicular to said free edges of said main walls over at least a part of the contour of said main walls starting from their pivot axis.

15. Display container according to claim 13 wherein said main walls of said half-shells are locally extended by lugs by means of which they are engaged with a pivot pin.

16. Display container according to claim 1 wherein snap-fastener means are associated with said two half-shells for releasably locking them in the closed position.

17. Display container according to claim 13 wherein snap-fastener means associated with said two half-shells for releasably locking them in the closed position are carried by two tangs each locally extending one of said main walls of said half-shells along said free edge thereof and overlapping each other in the closed position.

* * * * *